US005732589A

United States Patent [19]

McClellan et al.

[11] Patent Number: 5,732,589

[45] Date of Patent: Mar. 31, 1998

[54] AUTOMATICALLY ADJUSTABLE MULTIPLE CAM FOR FORGING MACHINE

[75] Inventors: Richard J. McClellan, Tiffin; Douglas A. Yaussy, Bucyrus; Steven C. Genet, Tiffin, all of Ohio

[73] Assignee: The National Machinery Company, Tiffin, Ohio

[21] Appl. No.: 653,667

[22] Filed: May 31, 1996

[51] Int. Cl.[6] ..... B21J 13/08

[52] U.S. Cl. ..... 72/405.12; 470/154; 72/452.5; 74/568 R

[58] Field of Search ..... 74/568 R; 72/452.4, 72/452.5, 452.6, 405.09, 405.11, 405.12; 470/95, 109, 154

[56] References Cited

U.S. PATENT DOCUMENTS

| | | | |
|---|---|---|---|
| 3,331,254 | 7/1967 | Stoll | 74/568 R |
| 4,257,253 | 3/1981 | Zanzerl | 74/568 R |
| 4,344,312 | 8/1982 | Flamme et al. | 72/452.7 |
| 4,898,017 | 2/1990 | Hite et al. | 72/405 |
| 5,005,397 | 4/1991 | Hite et al. | 72/405.12 |

FOREIGN PATENT DOCUMENTS

| | | | |
|---|---|---|---|
| 2002851 | 8/1970 | Germany | 74/568 R |

OTHER PUBLICATIONS

Nedschroef/Nedschroef Herentals N.V. Brochure.

*Primary Examiner*—David Jones

*Attorney, Agent, or Firm*—Pearne, Gordon, McCoy & Granger LLP

[57] ABSTRACT

A progressive forging machine having automatically adjustable cam timing for transfer finger opening and closing movement and for knockout pin action. The cams can be adjusted without manual effort to thereby reduce changeover time and the level of skill required to effect a changeover. For each of the transfer finger and knockout actions, a separate cam assembly is provided with a series of cam sections that are selectively repositionable on a common shaft by appropriate operation of a corresponding series of cam stop actuators and a common clutch actuator.

12 Claims, 9 Drawing Sheets

AUTOMATICALLY ADJUSTABLE MULTIPLE CAM FOR FORGING MACHINE

BACKGROUND OF THE INVENTION

The invention relates to improvements in progressive forging machines and in particular to apparatus for automatically changing the timing of instrumentalities that control the position of work piece blanks.

PRIOR ART

High speed forging machines, sometimes called formers, can require frequent tooling changeovers depending on the volume required of a particular part being run. U.S. Pat. No. 4,898,017, for example, shows systems for reducing the time and skill required for a changeover of tooling. In certain systems, cams for operating the fingers of the blank transfer device and cams for operating the blank knockouts at the punches were manually adjustable so that the timing of their rise, fall and/or dwell could be set for optimum performance. In the cited U.S. Pat. No. 4,898,017, the cam for operating the transfer is removed with the tooling for which it is set up and replaced with another cam associated with another tooling set.

SUMMARY OF THE INVENTION

The invention provides an automatically reprogrammable camshaft assembly for operating work piece positioning elements in a progressive forging machine. The camshaft assembly, according to the invention, can be adjusted by power operated actuators at the time the machine is being changed over with different tooling for a new production run. As disclosed, a cam assembly has a plurality of cams each associated with a respective one of the work stations of the machine. The cams are angularly adjustable on the camshaft by a clutch mechanism and a set of actuators that produce selective relative rotation between the cams and the shaft when the clutch is released. When the desired angular settings of the cams are obtained, the clutch mechanism is engaged to frictionally lock the cams or lobes onto the shaft.

In a preferred embodiment of a forging machine, the invention is applied to a cam for the transfer mechanism and to a cam for the timed knock out mechanism. The transfer cam controls the individual finger opening timing and has provisions for adjusting the timing of the rise section of the cam profile and, separately, the timing of the fall section of the cam profile at each work station independently of the corresponding timing at other work stations. The timed knock out cam controls the pins that push the work pieces from the tools and has provision for adjusting the timing of the fall of this cam profile. In each of the camshaft assemblies, a single actuator is arranged to clutch or declutch all of the adjustable cams. The adjustment of each cam profile section is performed by a separate associated power operated stop that relies on monitored rotation of the camshaft and appropriate braking and releasing of the section relative to the camshaft.

DESCRIPTION OF THE PREFERRED EMBODIMENT

Figures 8, 8A, 8B:
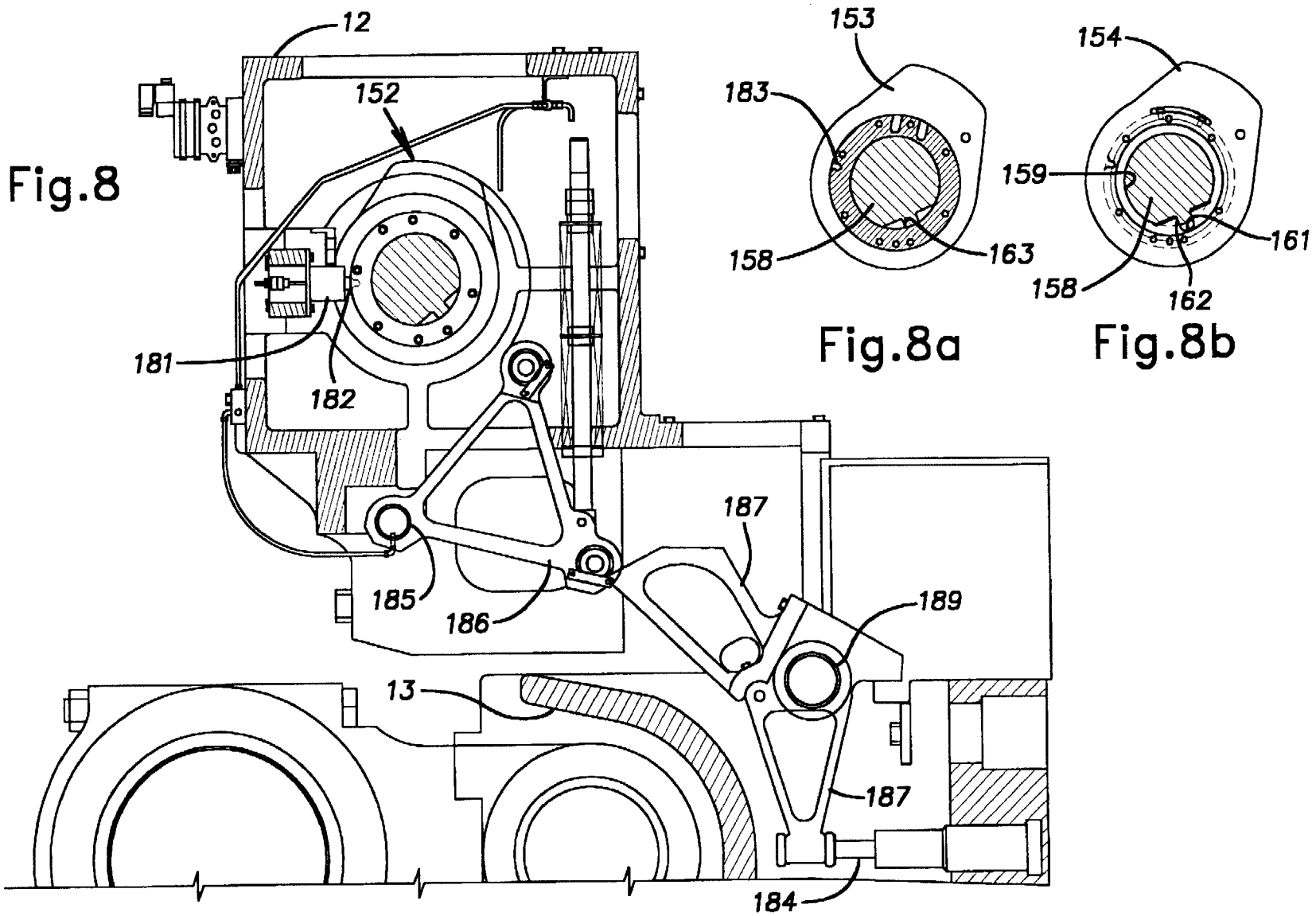
FIG. 8 is a cross-sectional view of a camshaft assembly for timed ejection or knockout of work pieces from the tools.
Figure 9:
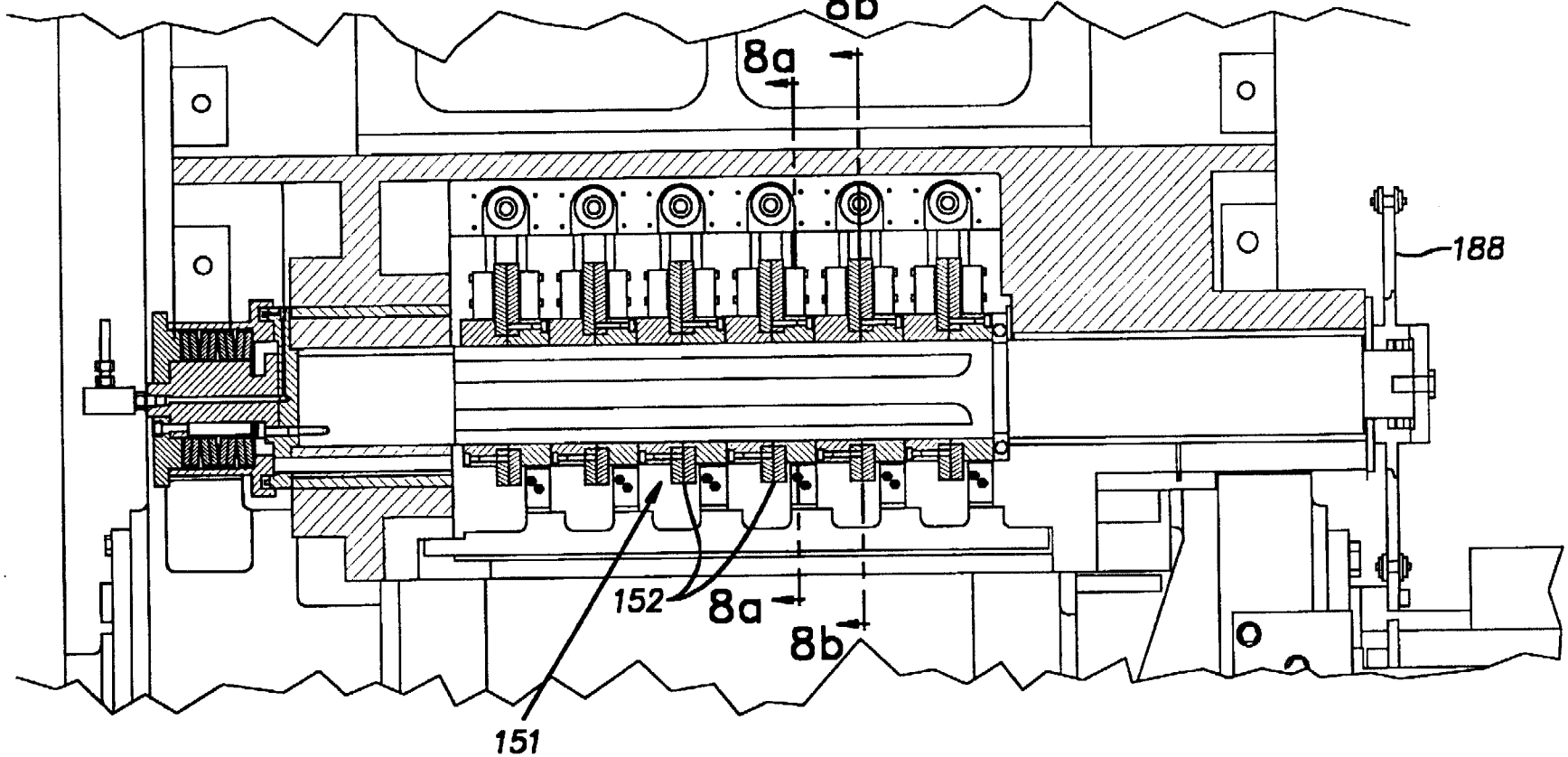
Figure 10:
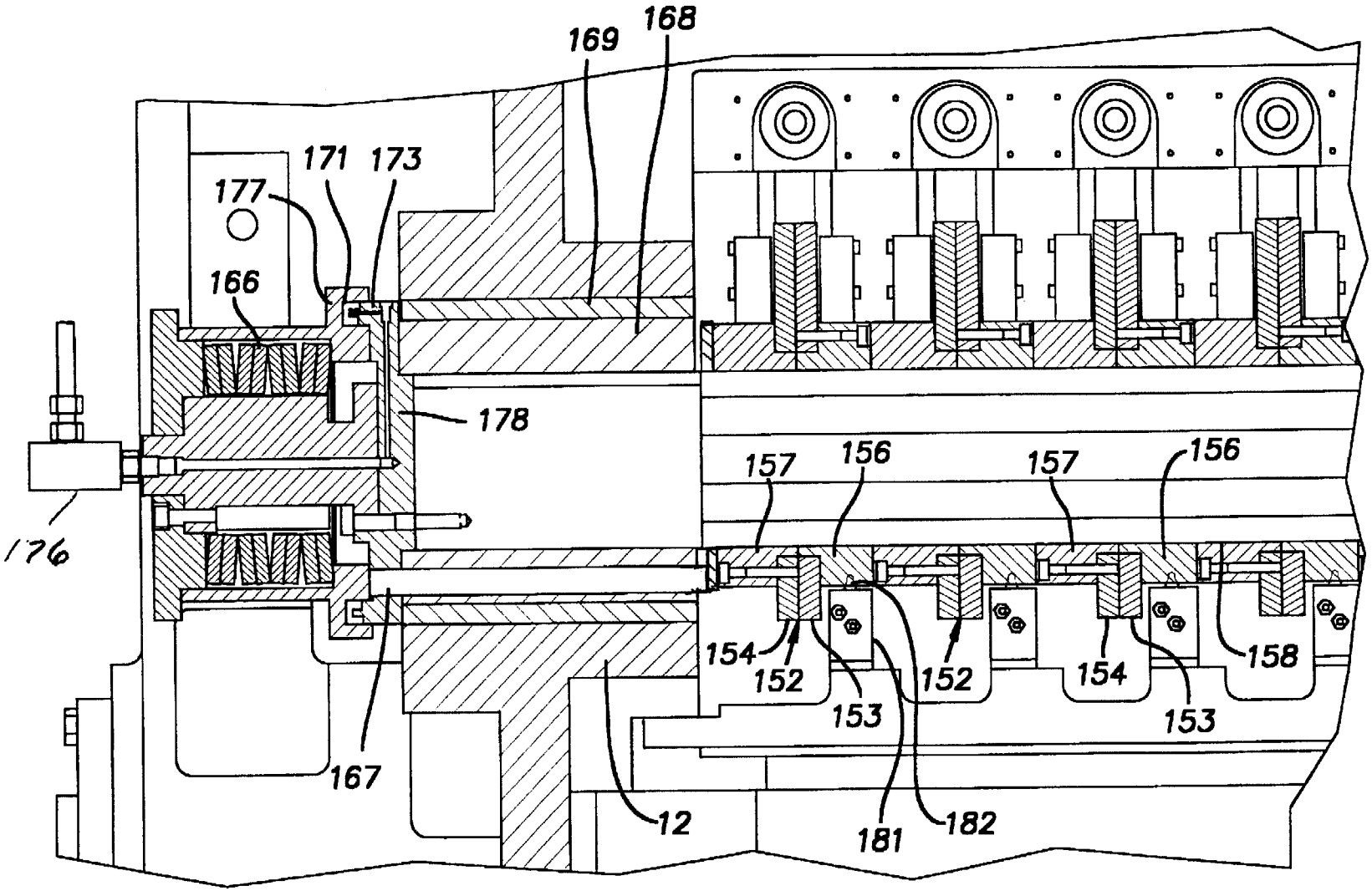

FIG. 8*a* is a view of a typical adjustable cam section taken in the plane 8*a*—8*a* in FIG. 9;

FIG. 8*b* is a view of a typical fixed cam section taken in the plane 8*b*—8*b* in FIG. 9;

FIG. 9 is a longitudinal cross-sectional view of the knockout camshaft assembly; and FIG. 10 is a longitudinal cross-sectional view of a clutch actuating end of the knockout camshaft assembly.

DESCRIPTION OF THE PREFERRED EMBODIMENT

A progressive forging machine 10, sometimes referred to as a former, has, in a generally conventional manner, a die breast 11 on a frame 12 and a slide 13 that reciprocates horizontally towards and away from the die breast. Work stations arranged in a regular spacing horizontally across the face of the die breast 11 and slide 13 are represented by dies carried in the die breast and tools mounted on the slide.

Figure 2:
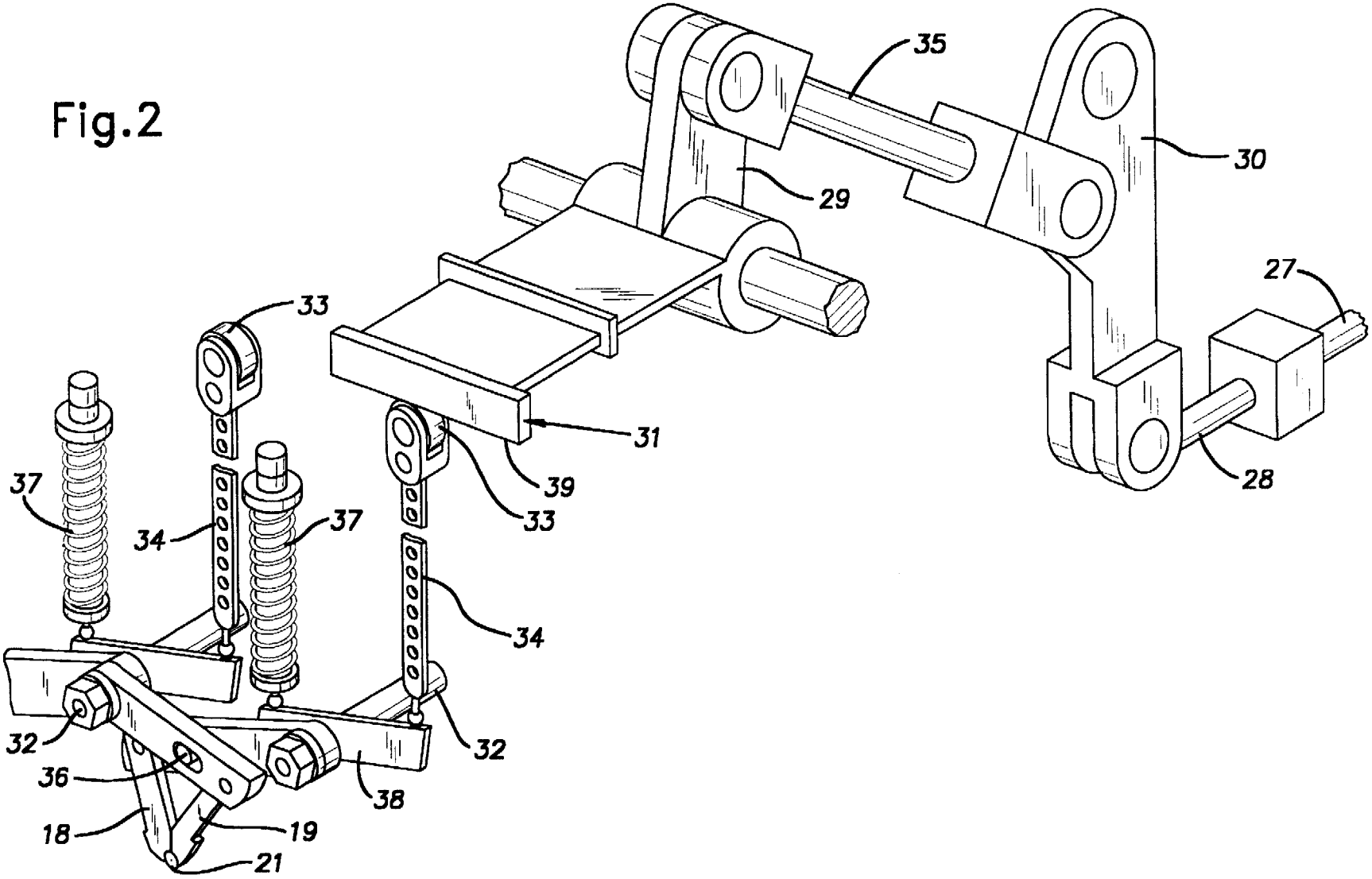
FIG. 2 is a schematic fragmentary perspective view of a typical set of transfer fingers of the machine of FIG. 1.
Figure 3:
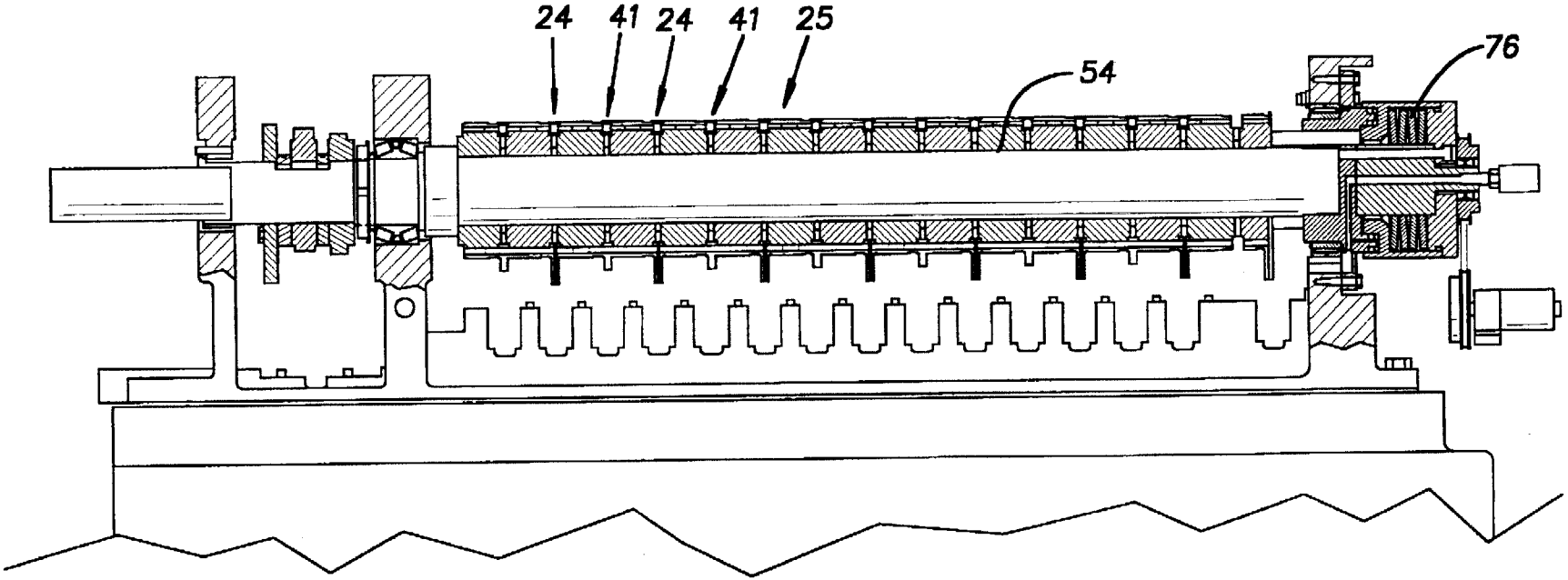
FIG. 3 is a longitudinal cross-sectional view of the transfer camshaft assembly.

A work piece transfer device, a portion of which is indicated generally at 17 in FIG. 2 has sets of opposed fingers 18, 19, each set being capable of gripping a work piece 21 at one work station and carrying it to a subsequent work station. One type of such transfer is shown in allowed U.S. patent application Ser. No. 08/385,324 filed Feb. 8, 1995, and assigned to the assignee of the present invention, the disclosure of which is hereby incorporated by reference. A typical set of fingers 18, 19 are open and closed by an associated cam 24 on a camshaft assembly 25 operating through a linkage comprising a follower lever 26 (FIG. 5), push rods 27, 28, motion transfer lever 30, connecting rod 35 and a bell crank 29 (FIG. 2).

As a cam 24 rotates during normal operation of the machine 10, the fingers 18, 19 are operated when an end 31 of the bell crank 29 is moved downwardly. A pivot shaft 32 is carried in a transfer carriage (not shown) such that it pivots clockwise on its axis in FIG. 2 when the bell crank lever end 31 is moved downwardly against a roller 33 on a push rod 34 connected to an arm 38 fixed to the pivot shaft. One of the fingers 18 is rotationally locked on the shaft 32 and the cooperating finger 19 is freely pivoted on an adjacent shaft 32. The fingers 18, 19 are keyed together by a pin 36 so that they open or close together. The fingers 18, 19, are biased to a closed position by a compression spring 37 that works through the arm 38 on the shaft 32. A surface 39 on the bell crank end 31 extends horizontally in the direction that the transfer carriage moves so that the roller 33 remains in contact with the bell crank and, consequently, under control of the cam 24.

The camshaft assembly 25, which extends parallel to the work station centers on the die breast, has a series of axially, regularly spaced cams 24 that are each associated with a set of transfer fingers typified by the set of fingers 18, 19 described above. The cams 24 are each an assembly of parts that represent a rise section 46, a dwell section 47, and a fall section 48 of the profile of the cam. The cam rise and fall sections 46 and 48 of the cam profile are subassemblies of a hub 49, 51 and a plate 52, 53, respectively. Each plate 52, 53 is bolted to the associated hub 49, 51 respectively. The hubs 49, 51 are assembled on an elongated shaft 54 of the assembly 25. Circular bores 56, 57 of the hubs 49, 51 are dimensioned to allow the hubs to rotate on the shaft 54 under conditions discussed below. As shown, the cam plates 52, 53 of a particular cam are assembled on the shaft 54 so that they are adjacent one another. The shaft 54 has a pair of longitudinal grooves cut into its otherwise circular profile to form a longitudinally extending integral drive key 61. Between each set of cam plates 52, 53 is a torque plate 62. The torque plate 62 has an irregular or acircular bore 63 that includes a notch or slot 64 that is complementary to the cross-section of the shaft key 61. The torque plates 62 associated with the cams 24 have a radial extension 66 that provides the dwell section 47 of the profile of the cam 24.

In the illustrated case, the camshaft assembly 25 is provided with the spaced cams 24 and intervening cams 41 so that it is capable of operating two different styles of transfer. For example, the cams 24 can be used with a so-called "straight across" transfer and the cams 41 can be used to operate a so-called "universal" transfer in which work pieces are transferred from work station to work station and turned end for end as desired. For this reason, the configuration of the profiles of the cams 24 and 41 will be different. The cams 41 are constructed in a manner to that described in connection with the cams 24. The intervening cams 41 include plates 71, 72 and hubs 73, 74 corresponding to the plates 52, 53 and hubs 49 and 51 of the cam 24. The plates 71 and 72 provide the rise and fall sections of the cam profile and a limited amount of dwell, there being no need for an extended dwell as is provided for the alternate cams 24 by the torque plate extension 66. Thus torque plates 75 associated with these alternate cams 41 are devoid of a radial extension equivalent to the extension 66 and are simply washer-like in their peripheral configuration. The interior configuration of the torque plates 75 is identical to that of the torque plate 62 so that these plates are rotationally locked to the shaft 54.

Figure 4:
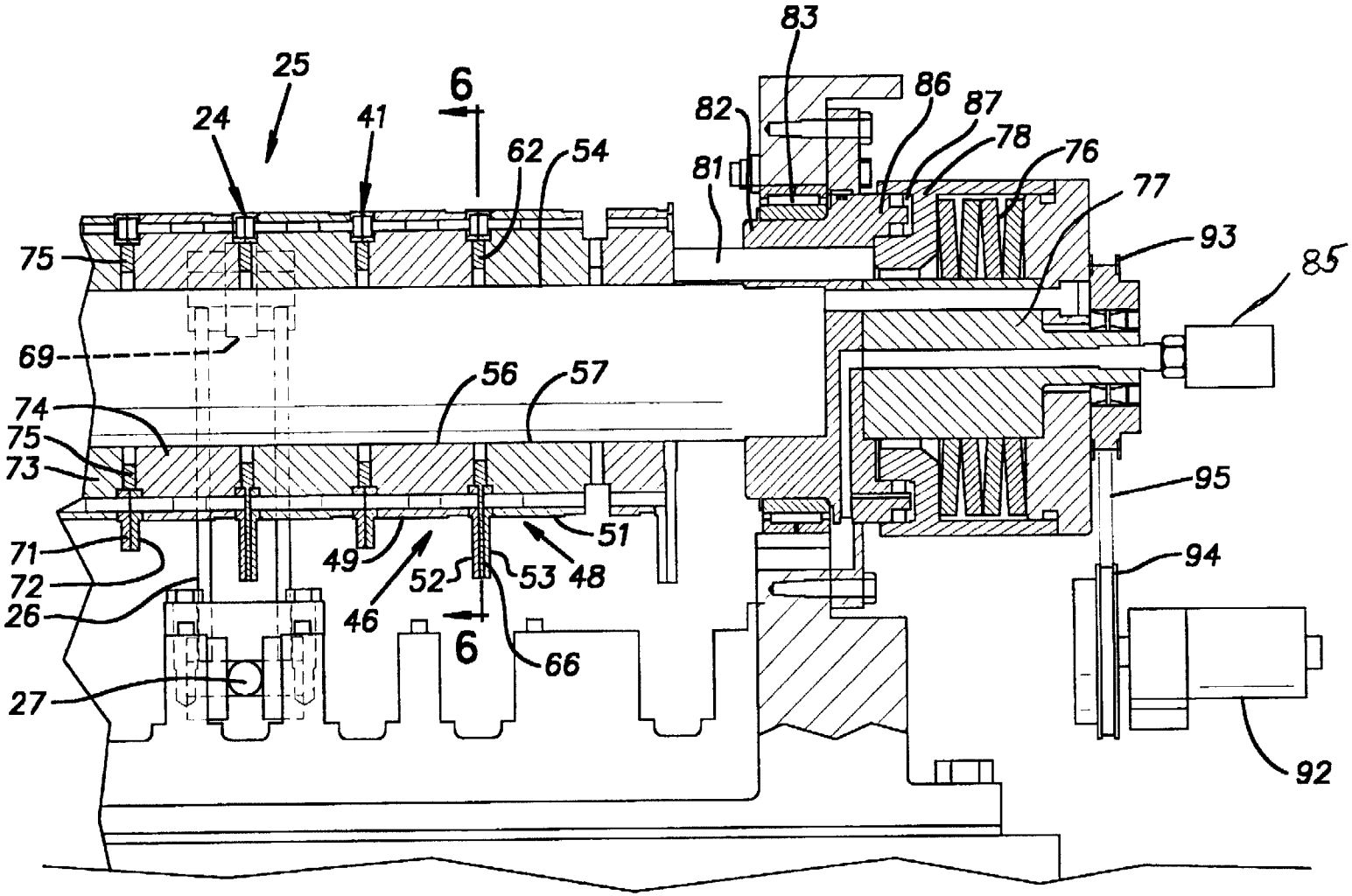
FIG. 4 is a longitudinal cross-sectional view of a clutch actuating end of the transfer camshaft assembly.
Figure 6:
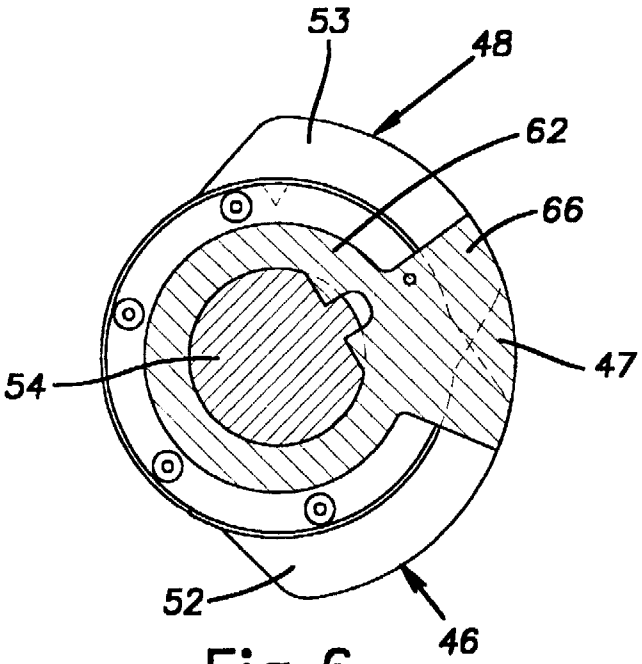
FIG. 6 is a transverse cross-sectional view through the transfer camshaft assembly taken in the plane 6—6 in FIG. 4.
Figure 5:
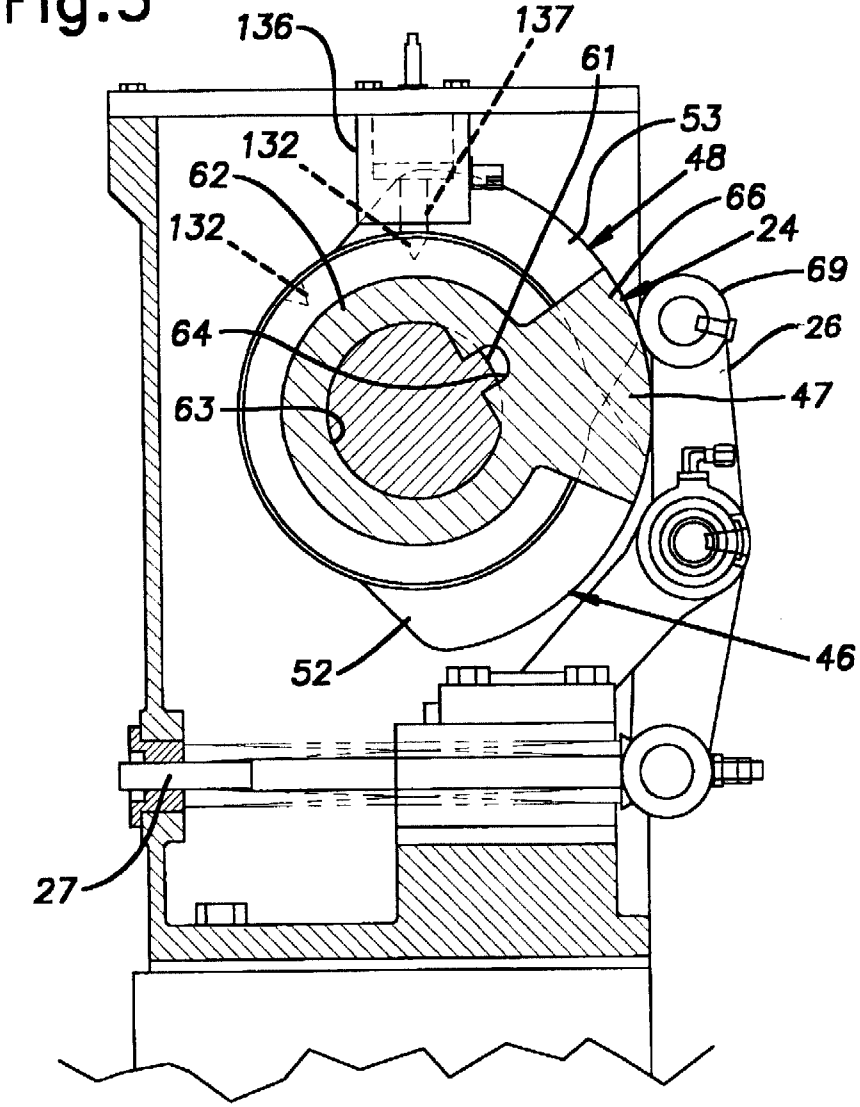
FIG. 5 is a transverse cross-sectional view of the camshaft assembly, a follower and a cam stop actuator for a typical work station.

An individual forked follower arm or pivotal lever 26 at each of the several work stations has a roller 69 shown in FIG. 5 (one is shown in phantom in FIG. 4) that rides on the outer periphery of an associated cam 24 or 41. The timing of the mechanical opening and closing movement of the set of transfer fingers that is produced by a cam 24 or 41 is the result of the angular positions of the rise, dwell and fall cam profiles on the shaft 54. The requisite timing of these opening and closing movements is dependent on the particular part being made and the tooling used to make it.

The hubs 49, 51 and 73, 74 and associated cam plates 52, 53 and 71, 72 are friction-locked in a selected angular position by a high axial clutch force developed by a spring pack 76 carried on an extension 77 on the end of the camshaft 54. More specifically, the spring pack 76 operating through a collar 78, presses on a plurality of pins 81 angularly displaced around the shaft 54 in a bushing 82 fixed to the shaft. The pins 81 bear against a torque plate that transfers the compressive spring force to all of the cam hubs and intermediate torque plates. The bushing 82 and, therefore, the shaft 54 is rotationally supported on the machine by a surrounding roller bearing 83. It will be understood that, apart from minor frictional effects, the full force of the spring pack 76 is applied to both radial faces of each of the hubs 49, 51 and 73, 74 by contact with the associated torque plates 62, 75. Since the torque plates 62, 75 are rotationally fixed on the shaft 54 by the slot and key structures, the cams 24 and 41 are frictionally locked in the angular positions they occupy when the force of the spring pack 76 is applied.

The clutch force of the spring pack 76 on the cams and torque plates is released by a hydraulically powered actuator in the form of an annular piston 86 formed by the bushing 82 working in a complementarily shaped annular chamber 87 in the collar 78. High pressure hydraulic oil admitted to the chamber 87 through a rotary hydraulic fitting 85 and a suitable port from a valve activated by a master controller of the machine causes the piston 86 to extend from the chamber 87 to separate the bushing 82 from the collar 78 and unload the force of the spring pack 76 from the pins 81 and, therefore, the torque plates 62, 75 and hubs 49, 51 and 73, 74. The angular position of the shaft 54 is electronically monitored by a resolver 92, known in the art, that is mechanically coupled to the shaft by toothed pulleys 93, 94 and a toothed belt 95.

Figure 1:
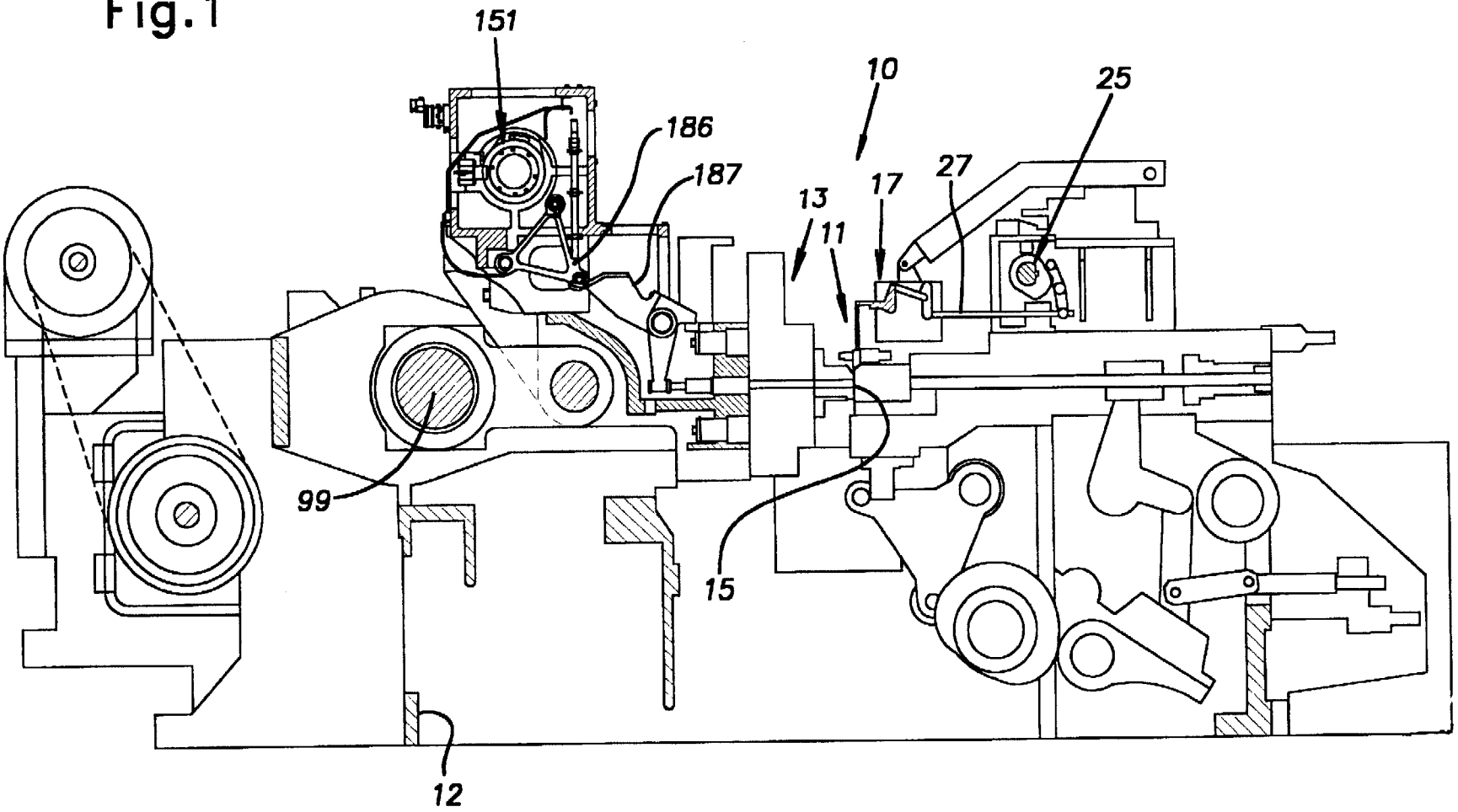
FIG. 1 is a somewhat schematic elevational view of a progressive forging machine embodying the invention.
Figure 7:
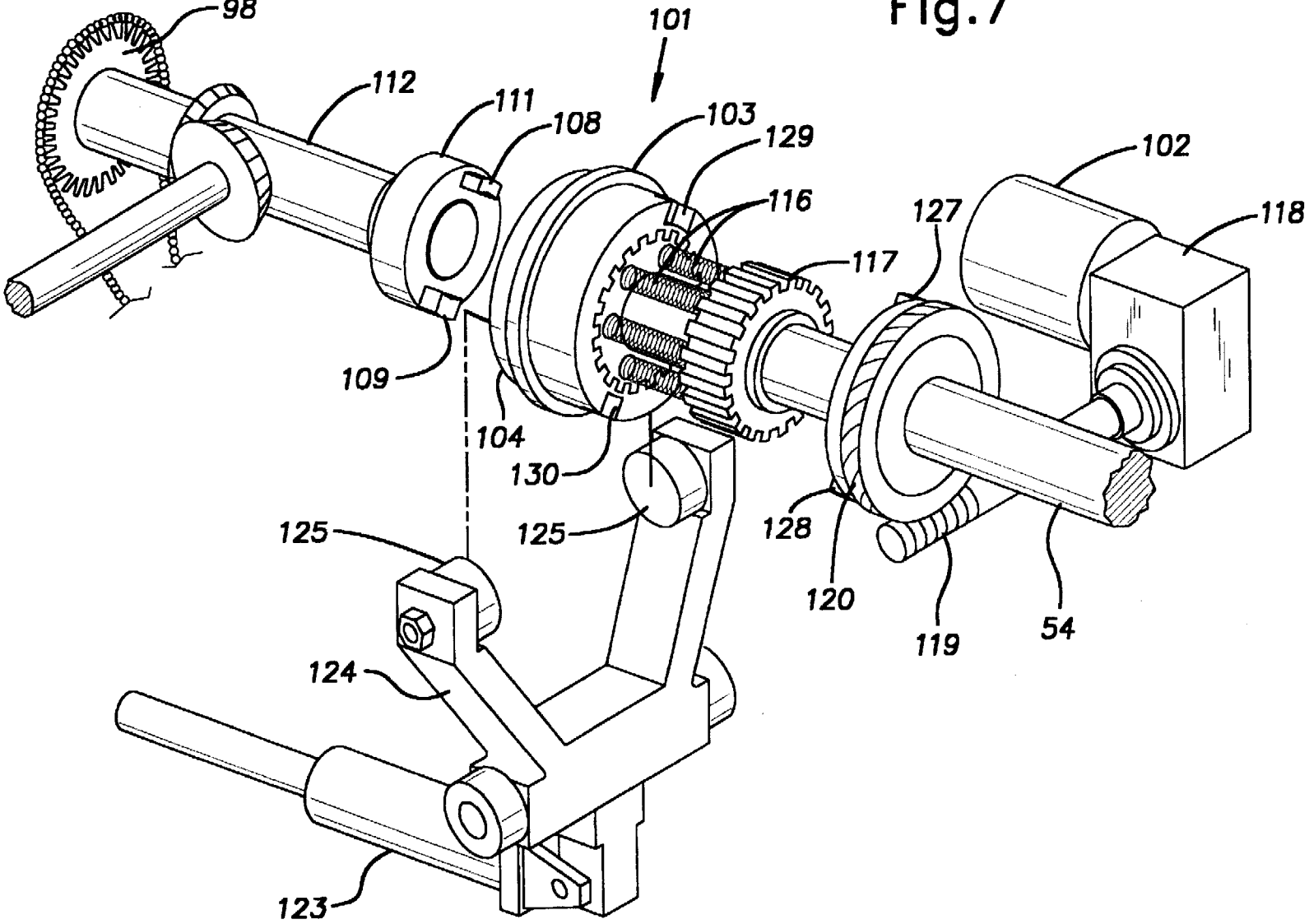
FIG. 7 is a schematic perspective view of an auxiliary drive for the transfer camshaft assembly.

The camshaft 54 is driven at its end opposite the clutch spring pack 76 by apparatus illustrated in FIG. 7. During normal operation of the machine 10, a chain sprocket 98 driven in synchronization with the rotation of a crank shaft 99 (FIG. 1) producing motion of the slide 13. The sprocket 98 is coupled to the camshaft 54 by a "dog" clutch generally indicated at 101. Alternatively, the camshaft 54 is rotated through the dog clutch by an auxiliary motor 102. An axially shiftable spool 103 of the dog clutch 101 selectively couples the sprocket 98 or the motor 102 to the camshaft 54. The spool 103 is suitably keyed or splined to the camshaft 54, by an externally splined hub 117 fixed to the camshaft, permitting it to move axially thereon but causing it to be rotationally fixed therewith. At one face 104, the spool 103 has diametrically opposed recesses that receive drive lugs 108, 109 of a coupler 111 fixed on a shaft 112 to which the sprocket 98 is mounted. In FIG. 7, the parts are illustrated in an axially exploded condition to reveal construction details; in practice, the coupler 111 is closer to the opposed face 104 of the spool 103, the hub 117 is in the spline of the spool 103 and a worm gear 120 is closer to the opposed face of the spool 103. When the spool 103 is leftward of the position in FIG. 7, the camshaft 54 is rotationally locked to the sprocket shaft 112 by the lugs 108, 109 thereby establishing the normal drive for the camshaft. The drive lugs or projections 108, 109 are configured with respect to the opposed spool recesses so that the shafts 54 and 112 can only be coupled in one angular relative position. The spool 103 is biased to the left by compression springs 116 supported on the hub 117.

The auxiliary motor 102, by command of the master controller of the machine 10, selectively drives the hub 117 serially through a gear box 118, a worm 119 and the worm gear 120. The sprocket 98 is disconnected from the camshaft 54 and the motor 102 is connected to the camshaft when the spool 103 is shifted to the right in FIG. 7 by operation of a hydraulically powered actuator 123 under the command of the master controller. The actuator 123 pivotally shifts a fork 124 that carries rollers 125 that bear against a radial face of the spool 103. The camshaft 54 is rotationally coupled to the gear 120 by projections 127, 128 on the gear received in recesses 129, 130 in the spool 103. The projections 127, 128 and recesses 129, 130 allow only one angular position to be assumed when these elements are coupled.

Each cam plate 52, 53 and 71, 72 has a corresponding radial indexing hole or axially oriented slot 132 in its associated hub 49, 51 and 73, 74. The angular relation between the cam plate and indexing hole is predetermined for purposes of allowing it to be automatically adjusted on the camshaft 54. Each hub 49, 51, 73, 74 has associated with it a pneumatically powered actuator 136 having a stop pin 137 that is adapted upon its energization to extend into the respective indexing or stop hole 132. The axis of movement of each individual stop pin 137 is on a line radial to the axis of rotation of the camshaft 54.

The cams are automatically adjusted in the following manner. Assuming that the machine is being set up to run a new part, the cams 24, 41 can be adjusted to properly manipulate the transfer fingers at each station in a manner that is timed in relation to slide movement so that optimum results can be obtained. This adjustment is achieved by releasing the clutch spring pack 76 through energization of the actuator chamber 87. At the same time, actuator 123 is caused to shift the spool 103 to declutch the sprocket 98 and clutch the motor 102 to the camshaft 54. The motor 102 under control of the master controller of the machine 10 rotates the camshaft 54 and at the same time the resolver 92 signals the master controller the exact angular position of the shaft. The master controller has stored in memory the angular location of all of the hub indexing holes 132. The actuators 136 are all pressurized at low pressure so that the stop pins 137 fall into their respective slots as the slots pass under the pins. Each stop pin arrests further rotation of its cam hub while the camshaft continues to rotate. In time, all of the hubs are stopped by their respective pins 137 and the pressure in the actuators 136 is increased to full pressure. Thereafter, the camshaft 54 can be rotated in the opposite direction until each of the stationary cam hubs reach a new desired angular position whereupon its stop pin can be withdrawn by the respective actuator and the hub will travel in unison with the shaft at this desired angular position. It will be understood that there is sufficient friction between each hub bore 56, 57 and the camshaft surface to produce rotation of a hub in unison with the shaft unless it is engaged by a stop pin. When all of the hubs have been released in their desired angular positions as determined by the master controller programming for the part to be next manufactured, the master controller exhausts the annular chamber 87 of hydraulic fluid to allow the spring pack 76 to apply a clutching action and frictionally lock the cam hubs 49, 51, 73, 74 in their desired angular positions on the camshaft. The motor 102 can be operated until the camshaft 54 is properly registered with the sprocket shaft 112 whereupon the master controller releases the power actuator 123 permitting the dog clutch spool 103 to shift into engagement with the sprocket shaft 112 and out of engagement with the auxiliary drive provided by the motor 102. At this time, as described, the transfer camshaft assembly 25 has been automatically programmed.

Referring now to FIGS. 8 through 10, a camshaft assembly 151 for timing the knockout of work pieces from the tools on the slide is provided. The camshaft assembly 151 is supported on the frame 12 for rotation about a fixed horizontal axis above and perpendicular to the path of the slide 13. The camshaft assembly 151 has a cam 152 for each of the work stations on the machine 10 and, in a manner similar to the described transfer camshaft assembly 25, such cams are automatically adjustable. Each cam comprises two cam plates 153, 154 each bolted on an associated hub 156, 157. Alternate hubs 157 are keyed to a shaft 158 of the assembly 151 by virtue of an irregularly shaped bore 159 that includes a slot 161 that fits closely with an integral key 162 made by slots formed on an otherwise round shaft. For cam adjustment purposes, intervening hubs 156 have circular bores 163 sized to rotate on the shaft 158 under certain conditions.

The sections of the cams 152 formed by the cam hubs 156 and associated cam plates 153 fixed thereto are angularly adjustable through a clutching and declutching action analogous to that described in connection with the cams of the transfer camshaft assembly 25. At one end of the shaft 158, a spring pack 166 applies a clutching force through a set of pins 167 against the adjacent cam hub. The spring compression force is transmitted serially through all of the hubs 156, 157 so that they are locked together by a high friction force. Since alternate hubs 157 are rotationally fixed or keyed to the shaft 158, all of the hubs are rotationally fixed to the shaft when the force of the spring pack 166 is applied. The pins 167 are carried in a sleeve 168 that is rotationally supported in a bearing 169. The spring pack force is released by admitting hydraulic fluid to an annular chamber 171 in a ring 177. The ring 177 is shifted to the left in FIG. 10 when the annular chamber 171 is hydraulically energized against an annular piston 173 formed by a disk 178 on the frame 12. The chamber 171 is energized through a rotary hydraulic coupling 176. A pneumatically operated actuator 181 with an extensible stop pin 182 is provided for each of the adjustable hubs 156 of the cams 152. The hubs 156 each have an axially oriented indexing slot or hole 183 adapted to receive a stop pin 182 when its actuator 181 is energized and the stop pin is driven radially towards the camshaft 158.

Each knockout cam 152 serves to hold a knockout pin 184 stationary through a linkage formed by a triangular follower lever 186 and a pivotal lever 187 as the slide 13 begins to retract. In a known manner, the triangular lever 186 rocks on a pin 185 that is stationary with respect to the machine frame 12 while the pivotal lever 187 pivots on a pin 189 that moves with the slide 13. The optimum duration of the knockout action where the pin 184 remains stationary while the slide retracts depends on the tooling and part being produced. The rise section of the cam 152 provided by the fixed cam plate 154 is unadjusted in its timing since it is only necessary to have the triangular lever 186 out of the way of the slide mounted lever 187 when the slide 13 is advancing. Adjustability is required in the fall section of the profile of the cam 152 that is provided by the adjustable cam plate 153 which controls the knockout action.

The knockout camshaft assembly 151 is adjusted in the following manner to achieve the proper timing of motion of the knockout pins 184. The clutch spring pack force is released by the master controller of the machine by pressurizing the chamber 171. The master controller stores in memory the actual angular position of each of the indexing holes 183 relative to the camshaft 158. The main drive of the machine is operated to rotate the camshaft 158 through a chain sprocket 188. At this time, the machine is not enabled to forge work pieces. The adjustable hubs 156, although released from the clutch force, rotate in unison with the shaft 158 due to frictional forces between them and the shaft. The actuators 181 are pressurized at low pressure at this time so that as the respective slots 183 pass below them they drop into the slots and stop further rotation of the hubs 156. With all of the adjustable hubs 156 stopped in a "home" position, the camshaft 158 is caused to rotate in reverse; when each hub 156 assumes a new desired angular position relative to the camshaft as stored in the memory of the master controller, it is released by withdrawing the stop pin 182 from the respective slot 183 by depressurizing the relevant actuator 181. The hub 156, by frictional forces, starts to rotate with the shaft 158 so as to maintain the desired new angular position. When all of the hubs 156 have been repositioned, the clutch actuator chamber 171 is depressurized by the master controller to apply the spring clutch force to all of the hubs 156 and frictionally lock them in their desired new positions. In this way, the camshaft assembly 151 is automatically adjusted.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

We claim:

1. A progressive forging machine having a plurality of work stations, an automatically adjustable camshaft assembly with a plurality of axially spaced cams on a rotary camshaft, each of the cams being associated with their respective work station, a linkage operated by each of the cams for positioning work pieces at its respective work station, each cam including a lift section and a fall section with at least one of said sections being angularly adjustable relative to the other cams of the assembly, and mechanism for selectively adjusting the angular position of each of the adjustable cam sections on the camshaft independently of the positions of the other adjustable cam sections, said mechanism including a clutch for selectively rotationally locking and unlocking the adjustable sections of the cams on the cam shaft and an actuator for selectively stopping each of the adjustable sections independently of the other adjustable sections, said mechanism including a separate power actuator adjacent each adjustable cam section for selectively stopping such cam section while the camshaft is rotated and said clutch unlocks such adjustable cam section.

2. A forging machine as set forth in claim 1, wherein said actuators include a member that is extensible into the rotary path of the associated adjustable cam section.

3. A forging machine as set forth in claim 1, including individual sets of work piece transfer fingers at each of said work stations, said camshaft assembly and linkage being arranged to separately operate said sets of transfer fingers.

4. A forging machine as set forth in claim 3, wherein each of said cams include separately adjustable lift sections and fall sections.

5. A forging machine as set forth in claim 1, including individual knockout pins on said slide at each of said work stations, said camshaft assembly and linkage being arranged to separately operate said knockout pins.

6. A progressive forging machine including a die breast and a slide reciprocating towards and away from the die breast, the die breast and slide having a plurality of aligned horizontally spaced work station centers, an automatically adjustable camshaft assembly mounted on the machine parallel to the work station centers and transverse to the line of movement of the slide, the camshaft assembly including a shaft, and a plurality of cams assembled on the shaft and spaced axially along the shaft at locations corresponding to said work station centers, the cams each including a rise section and a fall section, at least one of said sections being adjustable relative to said shaft, a clutch for locking and unlocking said adjustable cam sections onto said camshaft, a separate power actuator adjacent each adjustable cam section having a selectively operable stop arranged in one position to arrest rotation of its associated adjustable cam section relative to said camshaft when said clutch is in an unlocking condition and in another position to permit rotation of the associated adjustable cam section with said shaft, and a linkage operated by each of said cams for controlling the position of work pieces at said work station centers.

7. A forging machine as set forth in claim 6, wherein both said rise section and said fall section of said cams are adjustable.

8. A forging machine as set forth in claim 6, wherein said linkage is operative to control the movement of knockout pins associated with the tooling on said slide.

9. A forging machine as set forth in claim 6, wherein said linkage is operative to control the movement of transfer fingers associated with tooling on said die breast.

10. A progressive forging machine including slide recast and a slide reciprocating towards and away from the die breast, the die breast and slide having a plurality of aligned horizontally spaced work station centers, an automatically adjustable camshaft assembly mounted on the machine parallel to the work station centers and transverse to the line of movement of the slide, the camshaft assembly including a shaft, and a plurality of cams assembled on the shaft and spaced axially along the shaft at locations corresponding to said work station centers, the cams each including a rise section and a fall section, at least one of said sections being adjustable relative to said shaft, a clutch for locking and unlocking said adjustable cam sections onto said camshaft, a selectively operable stop arranged in one position to arrest rotation of each of said adjustable cam sections relative to said camshaft when said clutch is in an unlocking condition and in another position to permit rotation of said adjustable cam sections with said shaft, and a linkage operated by each of said cams for controlling the position of work pieces at said work station centers, said adjustable cam sections being separated by intervening elements that are rotationally locked to said shaft, said clutch being arranged to frictionally lock said cam sections to said intervening elements by an axial compressive force applied serially through said adjustable cam sections at said intermediate elements.

11. A forging machine as set forth in claim 10, wherein a clutch spring is arranged to apply said axial compressive force on said adjustable cam sections and intervening elements.

12. A forging machine as set forth in claim 11, including a fluid operated actuator arranged to overcome the compressive force of said clutch spring.

* * * * *

UNITED STATES PATENT AND TRADEMARK OFFICE

CERTIFICATE OF CORRECTION

PATENT NO. : 5,732,589

DATED : March 31, 1998

INVENTOR(S) : Richard J. McClellan et al.

It is certified that error appears in the above-identified patent and that said Letters Patent is hereby corrected as shown below:

Column 4, line 35, delete "diametrically" and insert --diametrally--.

Column 8, line 24 (claim 10, line 1), delete "slide recast" and insert --a die breast--.

Signed and Sealed this

Ninth Day of June, 1998

*Attest:*

Bruce Lehman

BRUCE LEHMAN

*Attesting Officer*

*Commissioner of Patents and Trademarks*